United States Patent [19]

Schilger

[11] Patent Number: 4,885,884

[45] Date of Patent: Dec. 12, 1989

[54] BUILDING PANEL ASSEMBLY

[76] Inventor: Herbert K. Schilger, 32 Castleglen Court N.E., Calgary, Alberta, Canada, T3J 2B8

[21] Appl. No.: 355,861

[22] Filed: May 19, 1989

Related U.S. Application Data

[63] Continuation of Ser. No. 198,220, May 25, 1988, abandoned.

[51] Int. Cl.[4] ..... E04B 5/52

[52] U.S. Cl. ..... 52/354; 52/356; 52/755

[58] Field of Search ..... 52/354, 355, 334, 335

[56] References Cited

U.S. PATENT DOCUMENTS

| | | | |
|---|---|---|---|
| 1,130,722 | 3/1915 | Fletcher | 52/356 X |
| 1,414,111 | 4/1922 | Burson | 52/356 |
| 1,504,325 | 8/1924 | Collins | 52/356 |
| 1,755,503 | 4/1930 | Collins | 52/354 |
| 1,862,831 | 6/1932 | Ryan | 52/354 X |
| 1,882,499 | 10/1932 | Johns | 52/454 |
| 2,209,514 | 7/1940 | Drummond | 52/356 X |
| 2,270,672 | 1/1942 | Heeren | 72/68 |
| 2,704,935 | 3/1955 | Uddenborg | 72/16 |
| 3,271,920 | 9/1966 | Downing, Jr. | 52/735 |
| 3,363,371 | 1/1968 | Villalobos | 52/356 X |
| 3,657,853 | 4/1972 | Wise | 52/735 X |
| 3,802,147 | 4/1974 | O'Konski | 52/735 X |
| 3,956,864 | 5/1976 | Fung | 52/414 |
| 4,602,467 | 7/1986 | Schilger | 52/319 |

FOREIGN PATENT DOCUMENTS

| | | | |
|---|---|---|---|
| 23247 | 4/1913 | Norway | 52/354 |

*Primary Examiner*—Carl D. Friedman

[57] ABSTRACT

A panel is described for use as a building component. It comprises: (a) a plurality of C-shaped sheet steel channel beams each having a central web and an inner and outer edge flange, said inner flanges having cuts therein at longitudinally spaced locations to form upwardly projecting lugs and said beam members being parallel to each other and laterally spaced from each other; (b) formwork panel members resting on the outer faces of the inner flanges and extending between the beams, said formwork panel members being held against said flanges by parts of said projecting lugs being bent around the edges thereof, with the remaining lug portions projecting outwardly between adjacent formwork panels and (c) a thin shell reinforced cementitious panel formed on said formwork panels with said remaining projecting lug portions being embedded in the cementitious material, thereby forming a reinforced building component.

11 Claims, 4 Drawing Sheets

BUILDING PANEL ASSEMBLY

This application is a continuation of application Ser. No. 198,220 filed May 25, 1988, abandoned.

BACKGROUND OF THE INVENTION

This invention relates to building constructions and, more particularly, to cementitious panels with metal studs or beams.

Many different types of cementitious building panels have been provided in the past to form walls, floors or roofs of building structures. Some of these panels have included insulation and others have included structures cast in the panels for attaching both interior and exterior finishing panels thereto.

Many examples of previously known cementitious wall panels are disclosed in U.S. Pat. Nos. 2,071,349; 2,270,672; 2,704,935; 3,442,056; 3,956,864; 4,112,646, 4,185,437 and 4,602,467. Fung, U.S. Pat. No. 3,956,864 in particular shows a support system for pouring a concrete panel in which projecting lugs are provided which become embedded in concrete.

It is an object of the present invention to provide a very simple and inexpensive cementitious wall, floor or roof construction panel which will be strong yet light in weight with steel studs or beams embedded in one face of the panel.

SUMMARY OF THE INVENTION

One embodiment of the present invention comprises a stud or beam member for use with cementitious building panels. This stud or beam member comprises a channel member having a web portion and a pair of edge flanges. Each of these edge flanges is preferably L-shaped and one of the flanges has a series of cuts therein at longitudinally spaced locations to provide lugs which can be bent outwardly with respect to the flange. Parts of each lug can be bent to serve as locking members for holding panels to be used as formwork, while the remainder of each lug can be left free to become embedded in the concrete panel as a locking connection between the stud or beam and the concrete panel.

Each lug according to the invention may be formed in a number of different ways. For instance, it may be formed by a series of cuts extending inwardly from the free edge of the flange. Alternatively, each lug may be formed by a shaped cut within the flange such that when the lug is bent outwardly, it provides shaped projections which can be further bent to serve as locking members to hold panels.

Another embodiment of the invention relates to a panel for use as a building construction unit and comprising a thin shell unit of reinforced, monolithic cementitious material having a large, planar outer face and an inner face interconnected by end edges and side edges. A plurality of the above stud or beam members are partially embedded in one face of the cementitious shell, these stud or beam members being parallel to each other, laterally spaced from each other and being preferably fabricated of about 10 to 25 gauge galvanized steel sheet.

The panels in accordance with this invention generally have a cementitious shell thickness of about 1 ½ to 2 inches with a reinforcing mesh embedded therein. As a consequence, they are quite light in weight, typically having a weight of about 20 pounds per square foot. Excellent strength is provided with quite shallow embedding of the stud lugs and these are typically embedded into the cementitious shell to a depth of about ⅜ inch to ½ inch. Preferably, the embedded lugs of the stud or beam are also mechanically connected to the reinforcing mesh.

Panels can be manufactured in many different sizes according to the present invention and a typical panel will have a height of 8 to 12 feet and lengths varying from 6 to 30 feet.

The construction panels of this invention have a number of advantages. For instance, there is no shadowing in the surface of the finished panels adjacent the embedded studs or beams. Furthermore, cracking of the panels adjacent the embedded lugs is significantly reduced. Also, cold bridges are minimized when used with rigid insulation as formwork.

BRIEF DESCRIPTION OF THE DRAWINGS

Certain preferred embodiments of the invention illustrated in the accompanying drawings wherein.

DETAILED DESCRIPTION OF THE INVENTION

Figure 1:
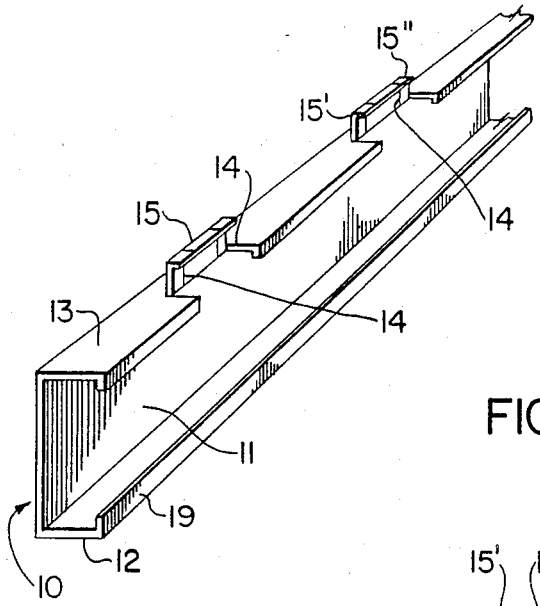
FIG. 1 is a perspective view of one stud or beam in accordance with the present invention.

Details of one stud or beam 10 of this invention are shown in FIG. 1. It is essentially a channel member having a web portion 11 with an outer flange 12 and an inner flange 33. These outer and inner flanges preferably have edge lip portions 19 perpendicular thereto and the outer flange 12 provides a surface to which finished panels may be attached.

The inner flange 13 has a plurality of longitudinally spaced lugs 15 formed by cuts 14 extending inwardly from the edge thereof. Each lug includes a central portion 15 and end parts 15' and 15'', with the lugs being longitudinally spaced along the flanges by about 12–18 inches. Each lug (15, 15', 15'') typically has a width of no more than about 6 inches, with central part 15 usually being wider than end parts 15′ and 15″.

Figure 2:
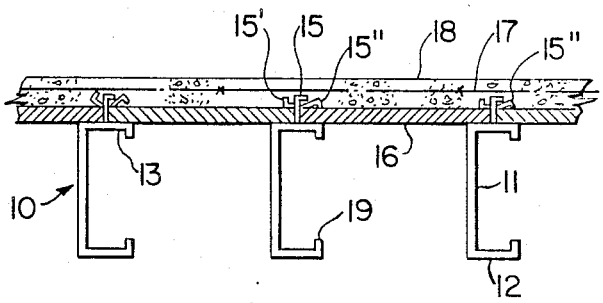
FIG. 2 is a sectional view of an assembly in accordance with the invention.

The studs or beams 10 can be arranged in spaced relationship as shown in FIG. 2 with formwork panels 16 resting on the outer faces of flanges 13. These panels 16 represent a lost formwork which remains as part of the final construction and may be made from a variety of materials, such as metal panels, drywall, plywood, rigid insulation, etc.. The ends of these panels 16 abut the upwardly turned lugs 15 and, with the panels 16 in place, the upwardly extending portions of lug parts 15′ and 15″ may be bent as shown in FIG. 2 to securely lock the panels 16 in place connected to the studs or beams 10.

The upwardly extending central tab portions 15 can remain in their upward position to serve as locking lugs for the studs or beams 10 within the concrete. Reinforcing mesh 17 can be positioned resting on the lugs 15 as shown in FIG. 2 and then a concrete panel 18 may be poured, this concrete surrounding the lugs 15 to provide a firm locking action. If desired, the reinforcing mesh may be mechanically connected to the lugs 15 to facilitate handling of the assembly before the concrete is poured.

The locking lug parts 15′ and 15″ have the advantages that by firmly locking the formwork panels 16 in place, the entire formwork assembly can be moved about and can be used either for prefabricated construction or for in situ panel constructions. Thus, the concrete can be poured and finished from the top as shown in FIG. 2, or the concrete can be poured in a form and the beam and formwork panel assembly can be placed upside down on top of the wet concrete such that the lugs (15, 15′, 15″) and the reinforcing mesh 17 sink into the wet concrete until the surface of the panels 16 come into contact with the surface of the wet concrete. After the concrete has cured, the complete panel assemblies can be lifted and moved for use as floor or wall systems.

Figure 3:
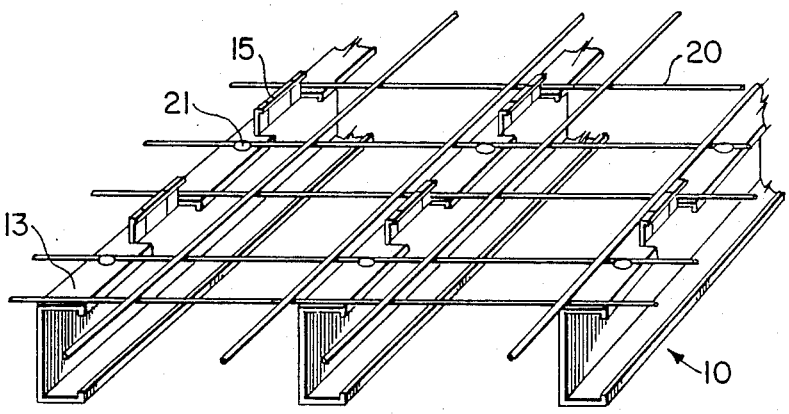
FIG. 3 is a perspective view of a further assembly.

An alternative form of the invention is shown in FIG. 3, in which a steel mesh 20 is laid on top of the studs or beams 10, resting on flanges 13. This mesh can be fastened to the flanges 13, e.g. by tack welds or by screws 21, and provides a lateral bracing for the studs 10 before the concrete is poured. This makes the studs easier to handle when the formwork is being positioned. The formwork panels 16 can be placed directly on top of the mesh 20 and, because of the support strength of the mesh, lighter formwork panels may be used than would otherwise be required. For instance, a material as light as aluminium foil coated cardboard may be used as formwork panels. With this arrangement, the lugs (15, 15′ 15″) are used in the same manner as described above, with lug parts 15′ and 15″ serving to hold down the formwork panels 16 on the mesh 20.

Figure 4:
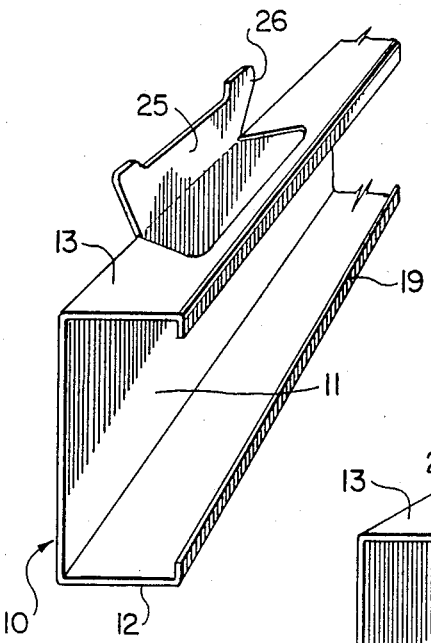
FIG. 4 is a perspective view of a second embodiment of the stud or beam.

A further embodiment of beam or stud of the invention is shown in FIG. 4. This includes the same web portion 11, outer flange 12, inner flange 13 and edge lips 19 as described hereinbefore. The flange 13 has an irregular cut so as to form lug 25 with projecting ears 26. The main portion 25 of the lug can remain in the vertical position shown in FIG. 4, while the ears 26 may be bent to hold drywall, etc. in the same manner as described in FIGS. 1 and 2.

Figure 5:
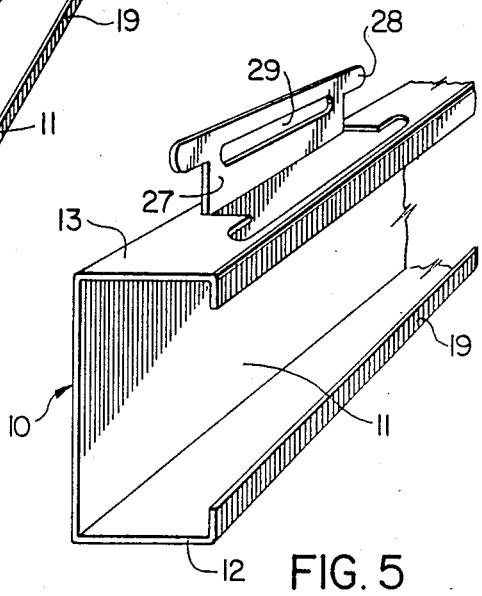
FIG. 5 is a perspective view of a third embodiment of the stud or beam.
Figure 6:
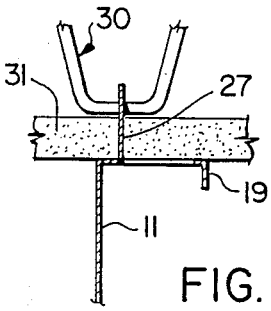
FIG. 6 is a partial sectional view showing the lug of FIG. 5.
Figure 7:
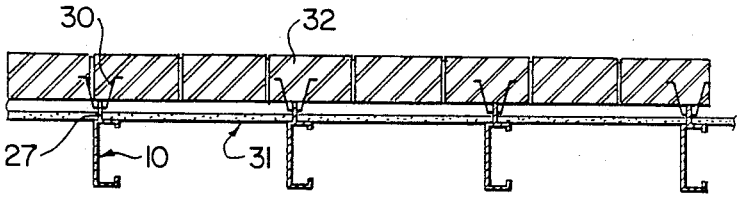
FIG. 7 is a partial sectional view showing the beams of FIG. 5 with brick ties.

A similar concept to FIG. 4 is shown in FIG. 5 and in this case the lug 27 includes projecting ears 28 and an elongated slot 29. The ears 28 can be bent to hold drywall panels, etc. and the slot 29 can serve a number of purposes, including locking of the lug within the concrete panel and as a means for holding a tie wire 30 as shown in FIG. 6. This tie wire 30 may be used for connecting a brick veneer structure 32, as shown in FIG. 7, to a main wall structure constructed of the beams of this invention.

Figure 8:
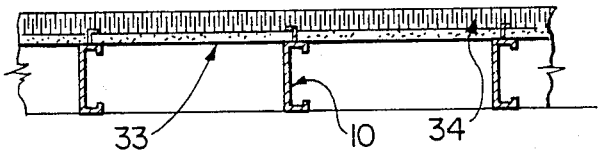
FIG. 8 is a sectional view showing the beams of the invention supporting a wall.

FIG. 8 shows how the beams of the invention may be used to support a simple wall, in this case drywall panels 33 held by the ears of the lugs and an outer insulation panel 34. Such insulation panel may conveniently be finished by polymeric paints.

Figure 9:
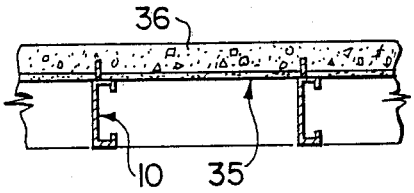
FIG. 9 is a sectional view showing the beams of the invention supporting a floor.

The beams of the invention may be used as a support framework for the pouring of concrete floors and this arrangement is shown in FIG. 9. Here, panel members 35 are mounted on the beams 10 with the lugs projecting upwardly. The panels 35 provide formwork and when concrete 36 is poured on top of the assembly, a rigid structure is formed in which the lugs of the beams 10 are firmly anchored in the concrete.

Figure 10:
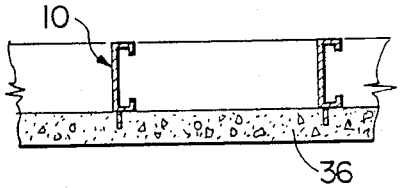
FIG. 10 is a sectional view showing the beams of the invention embedded onto of a concrete slab.

Alternatively, a concrete panel assembly may be formed in the manner shown in FIG. 10. In this case, the concrete panel 36 is poured on a flat surface and the beams 10 are placed on top with the lugs penetrating into the concrete.

Figure 11:
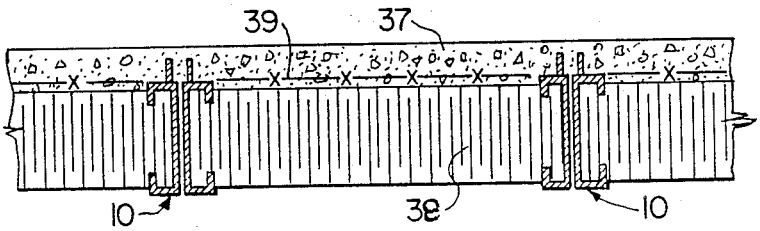
FIG. 11 is a sectional view showing the beams of the invention supporting a concrete floor.

In FIG. 11 a pair of beams 10 are used back to back to form a strong support structure for supporting a concrete floor 37. Solid blocks of insulations 38 may be placed between the beams 10 and this becomes a formwork for the pouring of concrete as well as remaining in place as permanent insulation. Thus, reinforcing mesh 39 is placed on top of the beams 10 and the concrete 37 is poured to form the structure as shown.

Figure 12:
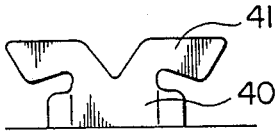
FIG. 12 is an illustration of a further design of flange lug according to the invention.
Figure 13:
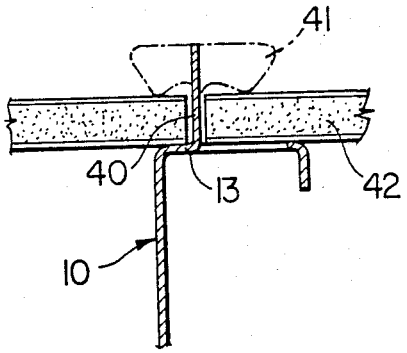
FIG. 13 is a sectional view showing the lug of FIG. 12.
Figure 14:
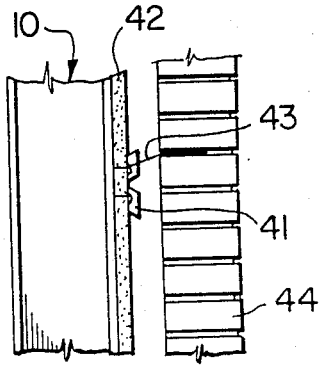
FIG. 14 is an elevation view showing the lug of FIG. 12 connected to a brick wall.

Yet another embodiment of the lugs of the invention is shown in FIGS. 12 and 13. Here, a projecting lug 40 has a pair of specially shaped ears 41. These ears 41 can be twisted perpendicular to the main body portion 40 of the lug in the manner shown in FIG. 13 to firmly anchor drywall panels 42. These can then be used as formwork for concrete as described hereinbefore. They may also be used as part of a wall structure as shown in FIG. 14 with the twisted ears 41 holding drywall panels 42 and the ears 41 also serving as anchors for tie wires 43 used to retain a brick veneer wall 44.

Figure 15:
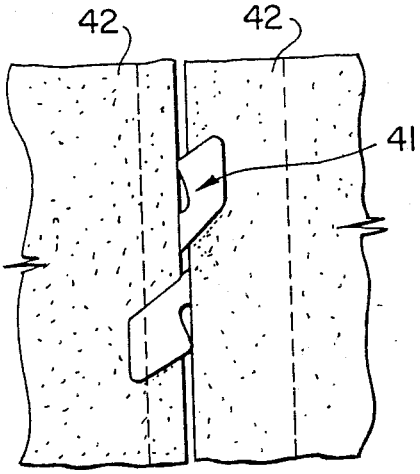
FIG. 15 is a side elevation showing the lug of FIG. 12 holding dry wall.
Figure 16:
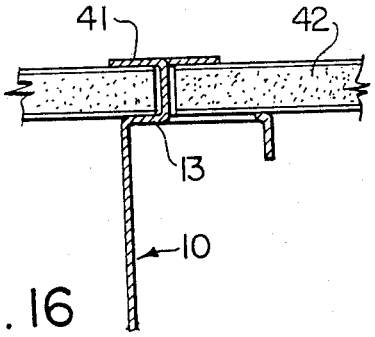
FIG. 16 is a partial sectional view of the arrangement shown in FIG. 15.

The ears 41 may also be used in the manner shown in FIG. 15 where they are further bent and flattened against the surface of drywall panels 42 as a means for retaining drywall.

The foregoing is considered as illustrative only of the principles of the invention. Since numerous modifications and changes will readily occur to those skilled in the art, it is not desired to limit the invention to the exact construction and operation shown and described, and accordingly all suitable modifications and equivalents may be resorted to as may fall within the scope of the invention.

I claim:

1. A panel for use as a building component comprising: (a) a plurality of C-shaped sheet steel channel beams each having a central web and an inner and outer edge flange, said inner flanges having cuts therein at longitudinally spaced locations to form upwardly projecting lugs, each said projecting lug having at least one lower flat part adjacent the inner flange and parallel to the central web and at least one upper part which includes at least one bendable part and at least one upwardly projecting anchoring part, and said beam members being parallel to each other and laterally spaced from each other; (b) formwork panel members resting on the outer faces of the inner flanges and extending between the beams, said framework panel member being held against said flanges by parts of said projecting lug bendable parts being bent around the edges thereof, with the upwardly projecting anchoring parts extending outwardly between adjacent framework panels and (c) a thin shell reinforced cementitious panel formed on said framework panels with said upwardly projecting anchoring parts being embedded in the cementitious material, thereby forming a reinforced building component.

2. A panel according to claim 1 wherein the lugs are formed by cuts extending inwardly from the free edge of said channel flange.

3. A panel according to claim 1 wherein the lugs are formed by cuts within the flange, each by having a projecting part with bendable ears integral therewith, said ears holding the formwork panels.

4. A panel according to claim 1 wherein a steel mesh is positioned between said formwork panel members and said inner flanges.

5. A panel according to claim 4 wherein said steel mesh is fastened to said inner flanges.

6. A formwork assembly for constructing a thin shell concrete building panel and comprising: (a) a plurality of C-shaped sheet steel channel beams each having a central web and inner and outer edge flanges, said inner flanges having cuts therein at longitudinally spaced locations to form upwardly projecting bendable lugs, each said projecting lug having at least one lower flat part adjacent the inner flange and parallel to the central web and at least one upper part which includes at least one bendable part and at least one upwardly projecting anchoring part, and said beam members being parallel to each other and laterally spaced from each other and (b) formwork panel members resting on the outer faces of the inner flanges and extending between the beams, said formwork panel members being held against said flanges by said bendable parts being bent around the edges thereof, with the upwardly projecting anchoring parts extending outwardly between adjacent formwork panels to act as locking members within a thin shell cementitious panel to be formed on said formwork panels.

7. A formwork assembly according to claim 6 wherein a steel mesh is positioned between said formwork panel members and said inner flanges.

8. A formwork assembly according to claim 7 wherein said steel mesh is fastened to said inner flanges.

9. A beam or stud member for use in thin shell concrete building panels and comprising a C-shaped sheet steel channel member having a central web and inner and outer edge flanges, said inner flange having cuts therein at longitudinally spaced locations to form upwardly projecting bendable lugs, each said projecting lug having at least one lower flat part adjacent the inner flange and parallel to the central web and at least one upper part which includes at least one bendable part and at least one upwardly projecting anchoring part, said at least one bendable part being adapted to hold formwork panels and said at least one upwardly projecting anchoring part being adapted to serve as a locking member within a thin shell cementitious panel to be formed on the formwork panels.

10. A beam or stud member according to claim 9 wherein the lugs are formed by cuts extending inwardly from the free edge of said flange.

11. A beam or stud member according to claim 9 wherein the lugs are formed by cuts within the flange, each lug having a projecting part with bendable ears integral therewith.

* * * * *